US010330265B2

(12) United States Patent
Zhu

(10) Patent No.: US 10,330,265 B2
(45) Date of Patent: Jun. 25, 2019

(54) FRONT LIGHT SOURCE AND DISPLAY DEVICE COMPRISING THE FRONT LIGHT SOURCE

(71) Applicant: BOE Technology Group Co., Ltd., Beijing (CN)

(72) Inventor: Ming Zhu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/811,382

(22) Filed: Nov. 13, 2017

(65) Prior Publication Data

US 2018/0299081 A1 Oct. 18, 2018

(30) Foreign Application Priority Data

Apr. 17, 2017 (CN) ..... 2017 1 0251061

(51) Int. Cl.
*F21K 9/64* (2016.01)
*F21V 11/00* (2015.01)
(Continued)

(52) U.S. Cl.
CPC ..... *F21K 9/64* (2016.08); *F21V 3/00* (2013.01); *F21V 7/0008* (2013.01);
(Continued)

(58) Field of Classification Search
CPC ..... F21K 9/64; F21V 7/0008; F21V 11/00; F21V 23/06; F21V 3/00; F21V 7/0083;
(Continued)

(56) References Cited

U.S. PATENT DOCUMENTS 7,429,753 B2 * 9/2008 Tanase ..... G02F 1/133603 257/40
7,806,542 B2 * 10/2010 Koma ..... B60Q 3/14 362/23.19

(Continued)

FOREIGN PATENT DOCUMENTS

CN 103542276 A 1/2014
WO 2017/055374 A1 4/2017

OTHER PUBLICATIONS

First Office Action, including Search Report, for Chinese Patent Application No. 201710251061.9, dated Sep. 4, 2018, 17 pages.

*Primary Examiner* — Christle I Marshall
(74) *Attorney, Agent, or Firm* — Westman, Champlin & Koehler, P.A.

(57) ABSTRACT

The present disclosure provides a front light source including: a transparent substrate; a plurality of light source elements provided on the transparent substrate; and a plurality of light absorbing elements provided at front sides of the plurality of light source elements. The light absorbing elements and the light source elements are in a one-to-one correspondence, an orthographic projection of each of the light source elements onto the transparent substrate is within an orthographic projection of one of the light absorbing elements corresponding to the each light source element onto the transparent substrate, and an area of the orthographic projection of each of the light source elements onto the transparent substrate is smaller than an area of the orthographic projection of one of the light absorbing elements corresponding to the each light source element onto the transparent substrate. The present disclosure also provides a display device including the front light source.

18 Claims, 4 Drawing Sheets

(51) Int. Cl.

| | |
|---|---|
| ***F21V 7/00*** | (2006.01) |
| ***F21V 3/00*** | (2015.01) |
| ***F21V 19/00*** | (2006.01) |
| ***F21V 23/06*** | (2006.01) |
| *F21Y 115/10* | (2016.01) |
| *F21Y 105/10* | (2016.01) |

(52) U.S. Cl.
CPC ..... *F21V 7/0083* (2013.01); *F21V 11/00* (2013.01); *F21V 19/0015* (2013.01); *F21V 23/06* (2013.01); *F21Y 2105/10* (2016.08); *F21Y 2115/10* (2016.08)

(58) Field of Classification Search
CPC ..... F21V 19/0015; F21Y 2105/10; F21Y 2115/10
See application file for complete search history.

(56) References Cited

U.S. PATENT DOCUMENTS

| | | | | |
|---|---|---|---|---|
| 7,843,527 | B2 * | 11/2010 | Young | G02F 1/1336 349/113 |
| 8,466,614 | B2 * | 6/2013 | Hsiao | G02F 1/133603 313/504 |
| 2008/0237611 | A1 * | 10/2008 | Cok | B82Y 20/00 257/79 |
| 2017/0331003 | A1 * | 11/2017 | Cheng | H01L 33/007 |

* cited by examiner

FRONT LIGHT SOURCE AND DISPLAY DEVICE COMPRISING THE FRONT LIGHT SOURCE

CROSS-REFERENCE TO RELATED APPLICATION

This application claims priority to Chinese Patent Application No. 201710251061.9 filed on Apr. 17, 2017 in the State Intellectual Property Office of China, the disclosure of which is hereby incorporated by reference in its entirety.

TECHNICAL FIELD

The present disclosure relates to the field of display technology, and particularly, to a front light source and a display device comprising the front light source.

BACKGROUND

A reflective display device can display a picture by utilizing environment light as an illumination source. In practical application of the reflective display device, when being in a weak light environment or in a darkroom environment, the reflective display device has lower brightness and poor display effect.

In order to obtain good display effect in the weak light environment or in the darkroom environment, generally, a front light source is added into the reflective display device to assist displaying of the reflective display device. However, the front light source in a conventional reflective display device is usually achieved by cooperating a scattering film of the reflective display device with a front light guide plate. In the front light source of such structure, outgoing of light occurs in both sides of the light guide plate, which leads to dramatically decrease of the contrast in a dark state displaying (namely in the weak light environment or in the darkroom environment), thereby causing reduced colour gamut and poor display effect.

SUMMARY

According to one aspect of embodiments of the present disclosure, there is provided a front light source comprising:

a transparent substrate;

a plurality of light source elements provided on the transparent substrate; and a plurality of light absorbing elements provided at front sides of the plurality of light source elements;

wherein, the plurality of light absorbing elements and the plurality of light source elements are in a one-to-one correspondence, an orthographic projection of each of the light source elements onto the transparent substrate is within an orthographic projection of one of the light absorbing elements corresponding to the each light source element onto the transparent substrate, and an area of the orthographic projection of the each of the light source elements onto the transparent substrate is smaller than an area of the orthographic projection of the one of the light absorbing elements corresponding to the each light source element onto the transparent substrate.

In some embodiments, the front light source further comprises: a plurality of quantum dot elements provided in the transparent substrate, wherein, the plurality of quantum dot elements and the plurality of light source elements are in a one-to-one correspondence, and an orthographic projection of each of the light source elements onto the transparent substrate is within an orthographic projection of one of the quantum dot elements corresponding to the each light source element onto the transparent substrate.

In some embodiments, each of the light source elements comprises a light source element for emitting blue light, and each of the quantum dot elements comprises quantum dots for emitting red light by being excited with the blue light and quantum dots for emitting green light by being excited with the blue light, the quantum dots for emitting red light and the quantum dots for emitting green light being mixed at a predetermined proportion.

In some embodiments, the plurality of light source elements are provided in array on the transparent substrate, and pitches between every two adjacent light source elements are configured so that a light emitted by the front light source is uniformly distributed.

In some embodiments, the pitches between every two adjacent light source elements are the same and are in the range of 1 millimeter~2.5 millimeters.

In some embodiments, the front light source further comprises: a reflecting element provided between each of the light source elements and a corresponding one of the light absorbing elements, and configured to reflect light emitted by the light source element towards a direction away from the corresponding one light absorbing element.

In some embodiments, each of the light absorbing elements has a size of not more than 70 μm in a direction parallel to the transparent substrate.

In some embodiments, a size of each of the quantum dot elements in a direction parallel to the transparent substrate is greater than a size of one of the light source elements corresponding to the each quantum dot element in the direction parallel to the transparent substrate, and a difference between the size of each of the quantum dot elements in the direction parallel to the transparent substrate and the size of one of the light source elements corresponding to the each quantum dot element in the direction parallel to the transparent substrate is determined based on a distance between the quantum dot element and the one of the light source elements corresponding to the quantum dot element in a direction perpendicular to the transparent substrate.

In some embodiments, an orthographic projection of each of the quantum dot elements onto the transparent substrate is within an orthographic projection of one of the light absorbing elements corresponding to the each quantum dot element onto the transparent substrate, and an area of the orthographic projection of each of the quantum dot elements onto the transparent substrate is smaller than an area of the orthographic projection of one of the light absorbing elements corresponding to the each quantum dot element onto the transparent substrate.

In some embodiments, the front light source further comprises: connection lines electrically connected to the plurality of light source elements, wherein, the connection lines are provided on the transparent substrate.

In some embodiments, a material for the connection line comprises an ITO or an IZO, and the connection line has a line width greater than or equal to 30 microns; or the material for the connection line comprises a metal, and the connection line has a line width less than or equal to 3 microns and is treated with surface oxidation.

In some embodiments, the transparent substrate comprises a first layer of transparent film and a second layer of transparent film, the quantum dot elements are formed on the first layer of transparent film, and the second layer of transparent film is formed on the quantum dot elements in order to protect the quantum dot elements.

In some embodiments, an area of the orthographic projection of each of the light source elements onto the transparent substrate is smaller than an area of the orthographic projection of one of the quantum dot elements corresponding to the each light source element onto the transparent substrate.

According to one aspect of embodiments of the present disclosure, there is provided a display device, comprising:

the front light source of any one of the above embodiments; and a display panel provided at a rear side of the front light source, wherein a reflecting component is provided at a side of the display panel away from the front light source.

In some embodiments, the plurality of light source elements are provided in array on the transparent substrate, and ratios of a distance between each of the light source elements and the reflecting component of the display panel in a direction perpendicular to the display panel to pitches between every two adjacent light source elements are in the range of 1:1~1:1.5.

In some embodiments, the front light source further comprises: connection lines electrically connected to the plurality of light source elements, wherein, the connection lines are provided on the transparent substrate; wherein, a size of the display device is less than or equal to 8 inches, and a material for the connection line comprises an ITO or an IZO; or the size of the display device is greater than 8 inches, and the material for the connection line comprises a metal.

DETAILED DESCRIPTION OF THE EMBODIMENTS

Figure 1:
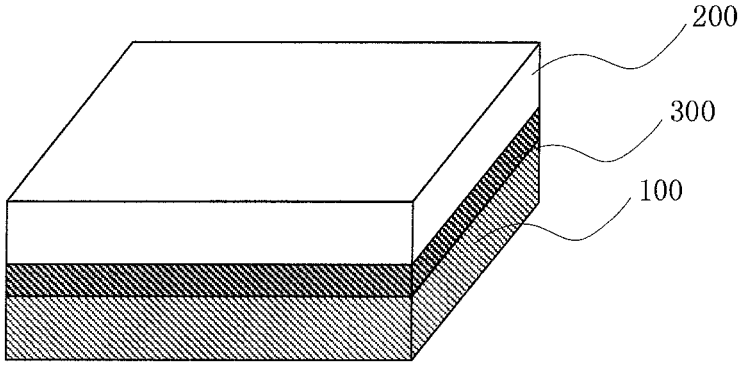
FIG. 1 is a schematic view showing a structure of a display device according to an embodiment of the present disclosure.

Technical solutions of the present disclosure will be described hereinafter in detail in conjunction with the embodiments and with reference to the attached drawings, wherein the same or like reference numerals refer to the same or like elements. These embodiments disclosed in the drawings intend to explain general inventive concept of the present disclosure, but not to limit the present disclosure.

Further, in the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

It should be noted that in the description, expressions "on/above . . . ", "formed on/above . . . " and "provided on/above . . . " may indicate one layer is formed or provided directly above another layer, or may indicate one layer is formed or provided indirectly above another layer, namely, there is/are other layer(s) provided between the two layers.

"Front" mentioned in the expression "front light source" used in the description indicates the light source is closer to a user than a display element of a display device in a normal use of the display device, that is, the light source is positioned in a side of the display element of the display element closing to the user. Accordingly, in the description, directional terminologies "front", "rear", "front side", "rear side" and the likes indicate relatively positional relationships among these components or these elements, for example, "a first element is positioned in a front side of a second element" indicates that the first element is closer to a user than the second element in a normal use of a display device.

FIG. 1 is a schematic view showing a structure of a display device according to an embodiment of the present disclosure. Referring to FIG. 1, the display device may comprise a display panel 100, a front light source 200 and an optical adhesive layer 300. The optical adhesive layer 300 is configured to bond the display panel 100 and the front light source 200 together. The adhesive layer 300 may be formed of transparent optical adhesive material.

Figure 2:
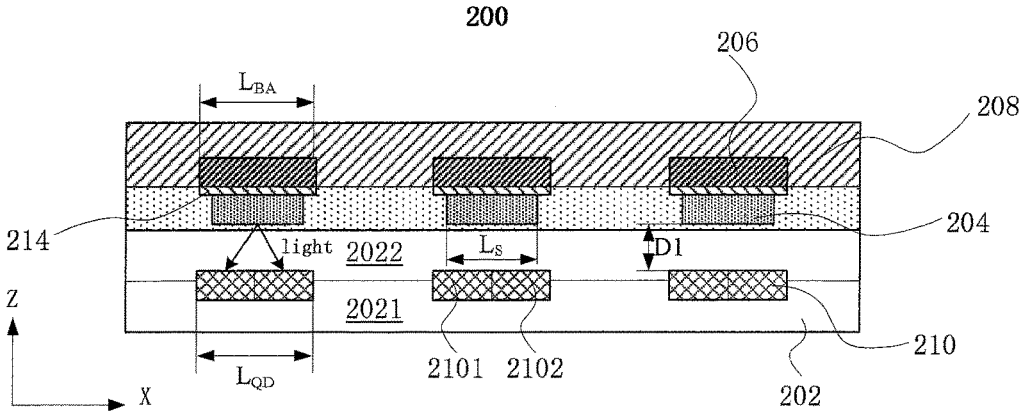
FIG. 2 is a sectional view of a front light source according to an embodiment of the present disclosure.
Figure 3:
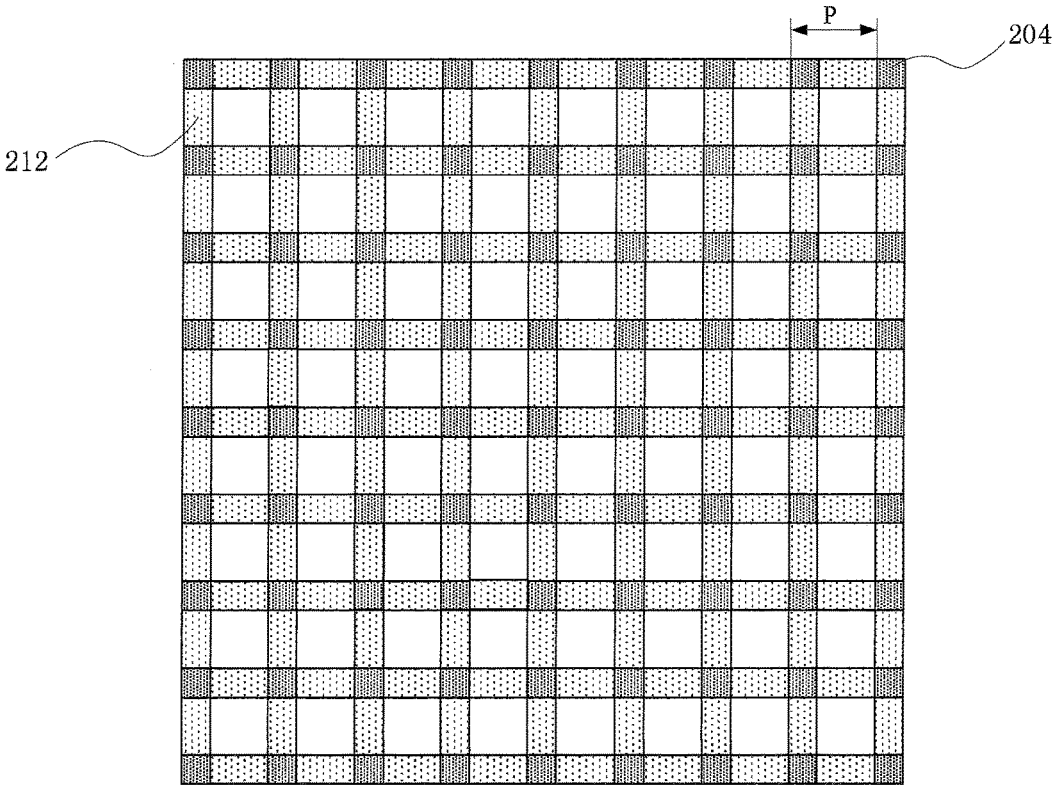
FIG. 3 is a top view of the front light source in FIG. 2.

FIG. 2 is a sectional view of a front light source according to an embodiment of the present disclosure. FIG. 3 is a top view of the front light source in FIG. 2. Referring to FIG. 2 and FIG. 3, the front light source 200 may comprise: a transparent substrate 202, a plurality of light source elements 204 provided on the transparent substrate 202, and a plurality of light absorbing elements 206. As shown in FIG. 2, the plurality of light absorbing elements 206 and the plurality of light source elements 204 are in a one-to-one correspondence, and the plurality of light absorbing elements 206 are provided at front sides of the plurality of light source elements 204, that is, are provided at sides of the plurality of light source elements 204 closing to a user. An orthographic projection of each light source element 204 onto the transparent substrate 202 is within an orthographic projection of one light absorbing element 206 corresponding to the each light source element 204 onto the transparent substrate 202, and an area of the orthographic projection of each light source element 204 onto the transparent substrate 202 is smaller than an area of the orthographic projection of the one light absorbing element 206 corresponding to the each light source element 204 onto the transparent substrate 202. As a result, when the light source element 204 emits light, the light emitted by the light source element 204 cannot go out of a front side (namely an upper side in FIG. 2) of the front light source because the size of the light absorbing element 206 is provided to be greater than the size of the light source element 204. Hence, the light emitted by the light source element 204 only goes out of a rear side (namely a lower side in FIG. 2) of the front light source, then is reflected by a reflecting component (see FIG. 4) of the display panel, and finally goes out of the front side of the display device. With the above structure, the front light source according to the embodiments of the present disclosure achieves one-sided outgoing of light and increases the contrast of the front light source, thereby achieving a better display effect.

Optionally, the front light source 200 may further comprise a transparent cover plate 208 provided above the plurality of light absorbing elements 206 and configured to protect the light absorbing elements 206 and the light source elements 204.

In one example, the light absorbing elements 206 may be black light absorbing elements, for instance, the light absorbing elements 206 may be formed of the same material as black matrix of a color film substrate. In one example, each of the light absorbing elements 206 has a size (such as size $L_{BA}$ in FIG. 2) of not more than 70 microns (μm) in a direction parallel to the transparent substrate 202, so that the light absorbing elements 206 are invisible when the front light source 200 is observed by human eyes.

In one example, the transparent substrate 202 may be formed of transparent polyimide (PI) material, for instance, the transparent substrate 202 may include a transparent PI film. The transparent substrate 202 may have a thickness of 30 microns~50 microns.

According to one exemplary embodiment of the present disclosure, the front light source 200 may adopt a luminescent solution of "monochromatic source+quantum dots (QDs)". Quantum dots (QDs) generally refer to semiconductor nanocrystals having a diameter in the range of 1 nm~10 nm. Quantum dots generally are semiconductor nano particles composed of group II-VI or III-V elements. Due to quantum confinement effect, quantum dots typically exhibit unique physical and chemical properties different from corresponding bulk phase materials and other molecular materials. Quantum dots can emit fluorescence by being excited by light having certain energy. Wavelength can be adjusted by changing size of the quantum dots. In addition, the quantum dots have excellent optical properties including broad and continuous absorption spectrum, narrow and symmetrical emission spectrum, excellent optical stability, high luminous efficiency.

Referring to FIG. 2, the front light source 200 may further comprise a plurality of quantum dot elements 210 provided in the transparent substrate 202. The plurality of quantum dot elements 210 and the plurality of light source elements 204 are in a one-to-one correspondence, and an orthographic projection of each light source element 204 onto the transparent substrate 202 is within an orthographic projection of one of the quantum dot elements 210 corresponding to the each light source element 204 onto the transparent substrate 202. Optionally, an area of the orthographic projection of each light source element 204 onto the transparent substrate 202 is smaller than an area of the orthographic projection of one of the quantum dot elements 210 corresponding to the each light source element 204 onto the transparent substrate 202.

In one example, a size of each quantum dot element 210 in a direction parallel to the transparent substrate 202 is greater than a size of one of the light source elements 204 corresponding to the each quantum dot element in the direction parallel to the transparent substrate 202, and a difference between the size of the each quantum dot element 210 in the direction parallel to the transparent substrate 202 and the size of the one of the light source elements 204 corresponding to the each quantum dot element in the direction parallel to the transparent substrate 202 is determined based on a distance between the each quantum dot element 210 and the one of the light source elements 204 corresponding to the each quantum dot element in a direction perpendicular to the transparent substrate 202. Referring to FIG. 2, the direction parallel to the transparent substrate 202 may be X direction, the direction perpendicular to the transparent substrate 202 may be Z direction, the size $L_{QD}$ of one quantum dot element 210 in the X direction is greater than the size $L_S$ of one of the light source elements 204 corresponding to the one quantum dot element 210 in the X direction, and a difference between the $L_{QD}$ and the $L_S$ is determined based on a distance D1 between the quantum dot element 210 and the light source element 204 in the Z direction. "A difference between the $L_{QD}$ and the $L_S$ is determined based on a distance D1 between the quantum dot element 210 and the light source element 204 in the Z direction" refers to that, when the distance D1 is relatively small, namely when the quantum dot element 210 is closer to the light source element 204, the difference between the $L_{QD}$ and the $L_S$ may be set to be relatively small; and when the distance D1 is relatively large, namely when the quantum dot element 210 is far away from the light source element 204, the difference between the $L_{QD}$ and the $L_S$ may be set to be relatively large. With this configuration, it is ensured that light emitted by each light source element can be irradiated completely onto the quantum dot element 210 corresponding to the each light source element 204, thereby increasing coefficient of utilization of the light emitted by the light source element.

In one example, the size $L_{QD}$ of one quantum dot element 210 in the X direction is greater than the size $L_S$ of one of the light source elements 204 corresponding to the one quantum dot element 210 in the X direction, by 2 microns~5 microns.

In one example, an orthographic projection of each quantum dot element 210 onto the transparent substrate 202 is within an orthographic projection of one of the light absorbing elements 206 corresponding to the each quantum dot element 210 onto the transparent substrate 202, and an area of the orthographic projection of the each quantum dot element 210 onto the transparent substrate 202 is smaller than an area of the orthographic projection of the one of the light absorbing elements 206 corresponding to the each quantum dot element 210 onto the transparent substrate 202. In this way, the light absorbing element 206 can completely cover the quantum dot element 210, thereby avoiding irradiation of environment light onto the quantum dot element to interfere with normal emission of the quantum dot.

In one example, the size $L_{BA}$ of each light absorbing element 206 in the X direction is greater than the size $L_{QD}$ of one of the quantum dot elements 210 corresponding to the each light absorbing element 206 in the X direction, by 2 microns~5 microns.

In one example, the transparent substrate 202 may comprise a first layer 2021 of transparent film and a second layer 2022 of transparent film, and both the first layer 2021 of transparent film and the second layer 2022 of transparent film may be transparent PI films. The quantum dot elements 210 are formed on the first layer 2021 of transparent film, and the second layer 2022 of transparent film is formed on the quantum dot elements 210. That is to say, all the quantum dot elements 210 are formed between the first layer 2021 of transparent film and the second layer 2022 of transparent film. With this design of double-layer configuration, the quantum dot elements can be protected from influence of external environment. In one example, the quantum dot elements 210 may be packaged within the transparent substrate 202 by screen printing or printing.

Specifically, each of the light source elements 204 may comprise a light source element emitting blue light, such as a light emitting diode (LED) emitting blue light, and each of the quantum dot elements 210 comprises quantum dots 2101 emitting green light by being excited with the blue light and quantum dots 2102 emitting red light by being excited with the blue light, mixed at a predetermined proportion.

In the abovementioned exemplary embodiment, the blue light emitted by the LED emitting blue light excites the quantum dots 2101 and the quantum dots 2102 respectively to emit green light and red light. In this way, once the quantum dots 2101 and the quantum dots 2102 are mixed at a predetermined proportion, the green light and the red light emitted by them after excitation are mixed at certain proportion, to obtain a mixed light after excitation as white light. It is found in experiments that, the above predetermined proportion may be one selected from a range from 1:2 to 2:1. That is to say, once the quantum dots 2101 emitting green light by being excited with the blue light and the quantum dots 2102 emitting red light by being excited with the blue light are mixed at a proportion selected from the range from 1:2 to 2:1, light-emitting elements composed of the blue light LED and the green light QDs and the red light QDs can generate standard white light. Optionally, the quantum dots 2101 and the quantum dots 2102 may be mixed at a predetermined proportion, such that the light-emitting elements composed of the blue light LED and the green light QDs and the red light QDs emits lights of three primary colors (red, green, blue), of which intensities are at a proportion of about 3:6:1. Standard white light can also be generated by the mixture with this proportion.

In the abovementioned exemplary embodiment, adoption of the luminescent solution of "monochromatic LED+quantum dots", especially of "blue light LED+green light and red light QDs", not only can generate standard white light, but also can provide colour gamut.

In another exemplary embodiment of the present disclosure, the front light source 200 may adopt a luminescent solution of "monochromatic LED+fluorescent powders". In one example, each light source element 204 may comprise an LED emitting blue light and fluorescent powders emitting yellow light. In another example, each light source element 204 may comprise an LED emitting (near)ultraviolet light and fluorescent powders emitting RGB colored light. Principles and constructions of the monochromatic LED and the fluorescent powders are similar to those of conventional light source, and are not described for the sake of brevity herein.

In one example, referring to FIG. 3, the plurality of light source elements 204 are provided in array on the transparent substrate 202, and pitches P between every two adjacent light source elements 204 are configured so that a light emitted by the front light source is uniformly distributed. In one example, the pitches P between every two adjacent light source elements 204 are the same. It is found in experiments that, when the pitches P are smaller than for example 1 millimeter, shadow of the light source element 204 is apparently visible; and when the pitches P are greater than for example 2.5 millimeters, production cost of the front light source 200 is increased obviously. Accordingly, in embodiments of the present disclosure, the pitches P are in the range of 1 millimeter~2.5 millimeters. Relationship between the pitches P and light distribution will be further described in detail hereinafter.

In one example, a blue light LED as the light source element may have a size $L_S$ of 6 microns~30 microns in the X direction. In one example, the blue light LED may be transferred to the transparent substrate formed with the quantum dot elements by processes including transfer printing.

In one example, the light absorbing elements 206 and the LEDs 204 are in a one-to-one correspondence, and each light absorbing element 206 and one of the LEDs 204 corresponding to the each light absorbing element 206 form a single unit that may be customized in an LED manufacturer and be provided directly by the LED manufacturer. In another example, each light absorbing element 206 and one of the LEDs 204 corresponding to the each light absorbing element 206 may be formed independently from each other. For instance, a plurality of light absorbing elements 206 are formed on the transparent substrate 202 formed with the LEDs 204, by a patterning process or an ink-jet printing process.

Further referring to FIG. 3, the front light source 200 may further comprise connection lines 212 configured for being electrically connected to the plurality of light source elements 204. The connection lines 212 are provided on the transparent substrate 202, and the connection lines 212 are electrically connected to the plurality of light source elements 204 arranged in array. In one example, a material for the connection line 212 may comprise transparent material including an ITO or an IZO. In this example, since the connection line is transparent, a line width of the connection line 212 may be relatively large, such as greater than or equal to 30 microns. In another example, the material for the connection line 212 may comprise a metal. In this example, since the connection line is non-transparent, a line width of the connection line 212 is generally relatively small, for instance, less than or equal to 3 microns, and the connection line 212 may be treated with surface oxidation to reduce reflectivity. As a result, the light emitted by the light source 204 is not reflected by the connection line 212 towards the front side, ensuring one-sided outgoing of the light, thereby further increasing the contrast.

Referring back to FIG. 2, the front light source 200 may further comprise a plurality of reflecting elements 214. The plurality of reflecting elements 214 and the plurality of light source elements 204 are in a one-to-one correspondence. Each reflecting element 214 is provided between the light source element 204 and the light absorbing element 206 corresponding to the each reflecting element 214, in order to reflect light emitted by each light source element 204 towards a direction away from the light absorbing element 206, thereby further increasing one-sided outgoing effect of the light. In one example, a size of the reflecting element 214 in the X direction may be approximately equal to that of one of the light absorbing elements 206 corresponding to the reflecting element 214 in the X direction. It should be noted that, in some other embodiments, a front light source may comprise a plurality of reflecting elements, instead of comprising a plurality of light absorbing elements. Specifically, the plurality of reflecting elements are provided at front sides of a plurality of light source elements. The plurality of reflecting elements and the plurality of light source elements are in a one-to-one correspondence. An orthographic projection of each of the light source elements onto the transparent substrate is within an orthographic projection of one of the reflecting elements corresponding to the light source element onto the transparent substrate, and an area of the orthographic projection of the each of the light source elements onto the transparent substrate is smaller than an area of the orthographic projection of the one of the reflecting elements corresponding to the each light source element onto the transparent substrate. With this structure, a light emitted by each light source element is also reflected towards a direction away from the light absorbing element, thereby increasing one-sided outgoing effect of the light.

Figure 4:
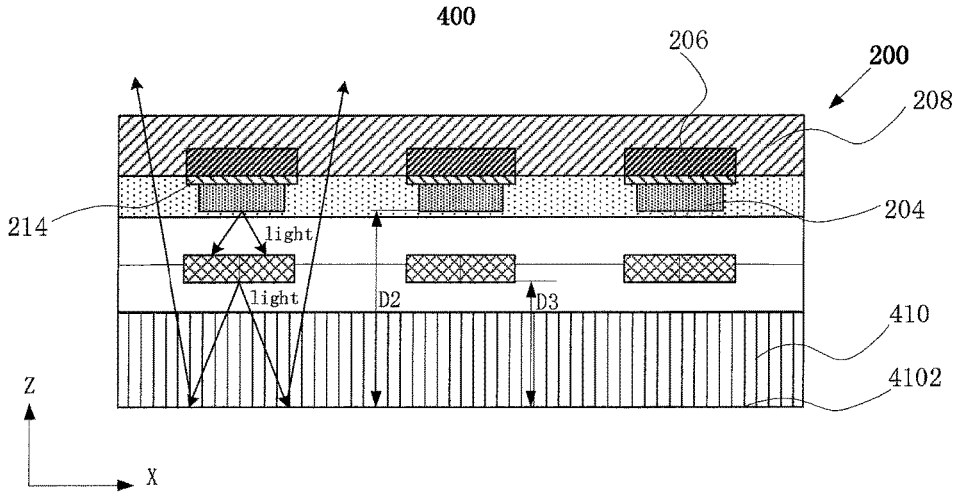
FIG. 4 is a sectional view of a display device according to an embodiment of the present disclosure.

According to another aspect of embodiments of the present disclosure, there is provided a display device. Referring to FIG. 4, the display device 400 may comprise: the abovementioned front light source 200; and a display panel 410 provided at a rear side of the front light source 200, wherein a reflecting component 4102 is provided at a side of the display panel 410 away from the front light source 200.

In one example, the reflecting component 4102 may comprise a reflecting surface or a reflecting sheet. The reflecting component may be integrally formed with the display panel 410, or, the reflecting component may be formed independently from the display panel 410 and then is bonded to the display panel 410 by means of adhesive and the likes.

Referring to FIG. 3 and FIG. 4, the plurality of light source elements 204 are provided in array on the transparent substrate 202, and pitches P between every two adjacent light source elements 204 are configured so that a light emitted by the front light source is uniformly distributed. In one example, the pitches P between every two adjacent light source elements 204 are the same, and the pitches P are in the range of 1 millimeter~2.5 millimeters.

In one example, ratios of a distance D2 between each light source element 204 and the reflecting surface or the reflecting sheet 4102 of the display panel 410 in a direction perpendicular to the display panel (namely Z direction in FIG. 4) to the pitches P between every two adjacent light source elements are in the range of 1:1~1:1.5. In an alternative example, ratios of a distance D3 between each quantum dot element 210 and the reflecting surface or the reflecting sheet 4102 of the display panel 410 in the direction perpendicular to the display panel (namely the Z direction in FIG. 4) to the pitches P between every two adjacent light source elements are in the range of 1:1~1:1.5. Herein, the distance D2 or the distance D3 may be regarded as "light-mixing distance".

Figure 5:
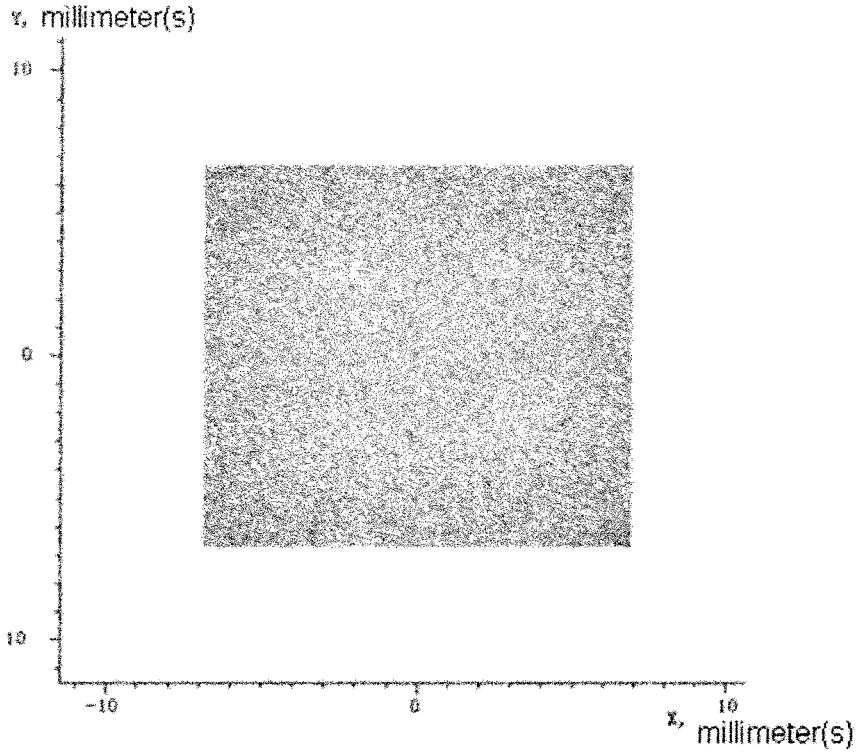
FIG. 5 is a simulation diagram of optical distribution of a display device according to an exemplary embodiment of the present disclosure.

In one example, the quantum dot element 210 has a size $L_{QD}$ of about 70 μm in the X direction, the light-mixing distance D3 is about 1.5 millimeters, and the pitch P is about 2.0 millimeters. FIG. 5 shows a simulation diagram of optical distribution of the display device with the above design values. In FIG. 5, coordinates X, Y represent respectively coordinates of different data points in a simulation model. In this simulation experiment, uniformity of optical distribution can be up to 97.7%.

In the above example, a uniform light-mixing effect can be achieved by designating the pitch P and ratio relationship between the light-mixing distance and the pitch P. Thereby, uniformity of light emission of the front light source is increased, and the display effect of the display device is increased.

According to embodiments of the present disclosure, the abovementioned display device may comprise but not limited to any of products or components having a display function, including electronic paper, mobile phone, tablet computer, TV, displayer, notebook computer, digital photo frame, navigator and the likes.

In one example, a size of the display device is less than or equal to 8 inches. In this example, a material for the connection line 212 may be selected from transparent materials including an ITO or an IZO. In this way, a line width of the connection line may be relatively large, such as greater than or equal to 30 microns.

In another example, the size of the display device is greater than 8 inches. In this example, the material for the connection line 212 may comprise a metal, in order to avoid excessive voltage drop occurred in wirings of longer connection lines from affecting uniformity of optical distribution. In this example, since the connection line is non-transparent, a line width of the connection line 212 is generally relatively small, for instance, less than or equal to 3 microns, and the connection line 212 may be treated with surface oxidation to reduce reflectivity. As a result, the light emitted by the light source 204 is not reflected by the connection line 212 towards the front side, ensuring one-sided outgoing of the light, thereby further increasing the contrast.

Although some embodiments according to the general inventive concept of the present disclosure have been shown and described, it will be apparent, however, for those skilled in the art that changes may be made in these embodiments without departing from the principles and spirit of the general inventive concept of the present disclosure, the scope of which is defined in the claims and their equivalents.

What is claimed is:

1. A front light source comprising:

a transparent substrate;

a plurality of light source elements provided on the transparent substrate;

a plurality of light absorbing elements provided at front sides of the plurality of light source elements; and a plurality of quantum dot elements provided in the transparent substrate;

wherein, the plurality of light absorbing elements and the plurality of light source elements are in a one-to-one correspondence, an orthographic projection of each of the light source elements onto the transparent substrate is within an orthographic projection of one of the light absorbing elements corresponding to the each light source element onto the transparent substrate, and an area of the orthographic projection of the each of the light source elements onto the transparent substrate is smaller than an area of the orthographic projection of the one of the light absorbing elements corresponding to the each light source element onto the transparent substrate;

wherein, the plurality of quantum dot elements and the plurality of light source elements are in a one-to-one correspondence, and an orthographic projection of each of the light source elements onto the transparent substrate is within an orthographic projection of one of the quantum dot elements corresponding to the each light source element onto the transparent substrate;

wherein, a size of each of the quantum dot elements in a direction parallel to the transparent substrate is greater than a size of one of the light source elements corresponding to the each quantum dot element in the direction parallel to the transparent substrate, and a difference between the size of each of the quantum dot elements in the direction parallel to the transparent substrate and the size of one of the light source elements corresponding to the each quantum dot element in the direction parallel to the transparent substrate is determined based on a distance between the quantum dot element and the one of the light source elements corresponding to the quantum dot element in a direction perpendicular to the transparent substrate.

2. The front light source of claim 1, wherein, each of the light source elements comprises a light source element for emitting blue light, and each of the quantum dot elements comprises quantum dots for emitting red light by being excited with the blue light and quantum dots for emitting green light by being excited with the blue light, the quantum dots for emitting red light and the quantum dots for emitting green light being mixed at a predetermined proportion.

3. The front light source of claim 2, wherein, the plurality of light source elements are provided in array on the transparent substrate, and pitches between every two adjacent light source elements are configured so that a light emitted by the front light source is uniformly distributed;

and wherein, the pitches between every two adjacent light source elements are the same and are in the range of 1 millimeter~2.5 millimeters.

4. The front light source of claim 3, further comprising: a reflecting element provided between each of the light source elements and a corresponding one of the light absorbing elements, and configured to reflect light emitted by the light source element towards a direction away from the corresponding one light absorbing element.

5. The front light source of claim 4, wherein, each of the light absorbing elements has a size of not more than 70 μm in a direction parallel to the transparent substrate;

wherein, a size of each of the quantum dot elements in a direction parallel to the transparent substrate is greater than a size of one of the light source elements corresponding to the each quantum dot element in the direction parallel to the transparent substrate, and a difference between the size of each of the quantum dot elements in the direction parallel to the transparent substrate and the size of one of the light source elements corresponding to the each quantum dot element in the direction parallel to the transparent substrate is determined based on a distance between the each quantum dot element and the one of the light source elements corresponding to the each quantum dot element in a direction perpendicular to the transparent substrate; and wherein, an orthographic projection of each of the quantum dot elements onto the transparent substrate is within an orthographic projection of one of the light absorbing elements corresponding to the each quantum dot element onto the transparent substrate, and an area of the orthographic projection of each of the quantum dot elements onto the transparent substrate is smaller than an area of the orthographic projection of one of the light absorbing elements corresponding to the each quantum dot element onto the transparent substrate.

6. The front light source of claim 5, further comprising: connection lines electrically connected to the plurality of light source elements, wherein, the connection lines are provided on the transparent substrate; wherein, a material for the connection line comprises an ITO or an IZO, and the connection line has a line width greater than or equal to 30 microns; or the material for the connection line comprises a metal, and the connection line has a line width less than or equal to 3 microns and is treated with surface oxidation.

7. The front light source of claim 1, wherein, the plurality of light source elements are provided in array on the transparent substrate, and pitches between every two adjacent light source elements are configured so that a light emitted by the front light source is uniformly distributed.

8. The front light source of claim 7, wherein, the pitches between every two adjacent light source elements are the same and are in the range of 1 millimeter ~2.5 millimeters.

9. The front light source of claim 1, further comprising: a reflecting element provided between each of the light source elements and a corresponding one of the light absorbing elements, and configured to reflect light emitted by the light source element towards a direction away from the corresponding one light absorbing element.

10. The front light source of claim 1, wherein, each of the light absorbing elements has a size of not more than 70 μm in a direction parallel to the transparent substrate.

11. The front light source of claim 1, wherein, an orthographic projection of each of the quantum dot elements onto the transparent substrate is within an orthographic projection of one of the light absorbing elements corresponding to the each quantum dot element onto the transparent substrate, and an area of the orthographic projection of each of the quantum dot elements onto the transparent substrate is smaller than an area of the orthographic projection of one of the light absorbing elements corresponding to the each quantum dot element onto the transparent substrate.

12. The front light source of claim 1, wherein, the transparent substrate comprises a first layer of transparent film and a second layer of transparent film, the quantum dot elements are formed on the first layer of transparent film, and the second layer of transparent film is formed on the quantum dot elements in order to protect the quantum dot elements.

13. The front light source of claim 1, wherein, an area of the orthographic projection of each of the light source elements onto the transparent substrate is smaller than an area of the orthographic projection of one of the quantum dot elements corresponding to the each light source element onto the transparent substrate.

14. The front light source of claim 1, further comprising: connection lines electrically connected to the plurality of light source elements, wherein, the connection lines are provided on the transparent substrate.

15. The front light source of claim 14, wherein, a material for the connection line comprises an ITO or an IZO, and the connection line has a line width greater than or equal to 30 microns; or the material for the connection line comprises a metal, and the connection line has a line width less than or equal to 3 microns and is treated with surface oxidation.

16. A display device, comprising:

the front light source of claim 1; and a display panel provided at a rear side of the front light source, wherein a reflecting component is provided at a side of the display panel away from the front light source.

17. The display device of claim 16, wherein, the plurality of light source elements are provided in array on the transparent substrate, and ratios of a distance between each of the light source elements and the reflecting component of the display panel in a direction perpendicular to the display panel to pitches between every two adjacent light source elements are in the range of 1:1~1:1.5.

18. The display device of claim 16, wherein, the front light source further comprises: connection lines electrically connected to the plurality of light source elements, wherein, the connection lines are provided on the transparent substrate; wherein, a size of the display device is less than or equal to 8 inches, and a material for the connection line comprises an ITO or an IZO; or the size of the display device is greater than 8 inches, and the material for the connection line comprises a metal.

* * * * *